US007002171B2

(12) United States Patent
Rantala et al.

(10) Patent No.: US 7,002,171 B2
(45) Date of Patent: Feb. 21, 2006

(54) METHOD FOR IMPROVING THE QUALITY OF CATHODES IN ELECTROLYSIS

(75) Inventors: Ari Rantala, Porvoo (FI); Henri Virtanen, Pori (FI)

(73) Assignee: Outokumpu Technology Oy, Espoo (FI)

( * ) Notice: Subject to any disclaimer, the term of this patent is extended or adjusted under 35 U.S.C. 154(b) by 207 days.

(21) Appl. No.: 10/481,211

(22) PCT Filed: Jun. 14, 2002

(86) PCT No.: PCT/FI02/00521

§ 371 (c)(1),
(2), (4) Date: Dec. 17, 2003

(87) PCT Pub. No.: WO03/000959

PCT Pub. Date: Jan. 3, 2003

(65) Prior Publication Data

US 2004/0173453 A1 Sep. 9, 2004

(30) Foreign Application Priority Data

Jun. 25, 2001 (FI) ..... 20011350

(51) Int. Cl.
*G01N 21/86* (2006.01)

(52) U.S. Cl. ..... 250/559.4; 250/208.1

(58) Field of Classification Search ..... 250/559.4
See application file for complete search history.

(56) References Cited

U.S. PATENT DOCUMENTS 6,646,733 B1 * 11/2003 Marttila ..... 356/237.1

FOREIGN PATENT DOCUMENTS

| | | |
|---|---|---|
| GB | 2 092 178 | 8/1982 |
| WO | 88/09400 | 12/1988 |
| WO | 01/35083 | 5/2001 |

* cited by examiner

*Primary Examiner*—David Porta
*Assistant Examiner*—Tony Lu
(74) *Attorney, Agent, or Firm*—Morgan & Finnegan, LLP

(57) ABSTRACT

The invention relates to the improvement in the quality of cathodes produced in an electrolysis process. The surface of a cathode lifted from the cell during the cathode cycle is photographed and the physical quality of the cathode can be investigated in real time by means of equipment based on image-analysis. On the basis of the quality of the cathode surface, it is possible to monitor and control the electrolysis conditions in order to improve the quality of the cathode. The method is extremely suitable for the electrolytic purification of copper.

8 Claims, No Drawings

METHOD FOR IMPROVING THE QUALITY OF CATHODES IN ELECTROLYSIS

The method relates to the improvement in the quality of cathodes produced in an electrolysis process. The surface of a cathode lifted from the cell during the cathode cycle is photographed and the physical quality of the cathode can be investigated in real time by means of equipment based on image-analysis. On the basis of the cathode surface quality, it is possible to monitor and control the electrolysis conditions in order to improve the quality of the cathode. The method is extremely suitable for the electrolytic refining of copper.

In the electrolytic treatment of metals, the desired metal is precipitated onto the surface of an electrode, the cathode. The treatment is performed by means of electric current in an electrolysis cell, where a set of plate-like anodes and plate-like cathodes, made of electro conductive material, are submerged in an alternating fashion in the liquid, or electrolyte. The desired metal is precipitated onto the cathode either so that in the electrolytic treatment, a soluble anode made of the same metal as the one to be precipitated is used, or there is an insoluble anode. A soluble anode would be used, for instance, in copper precipitation, and an insoluble anode for example in nickel or zinc precipitation.

In the electrolytic refining of copper, the impure so-called anode copper is dissolved by means of electric current; the dissolved copper is reduced onto the cathode plate as extremely pure, so-called cathode copper. A sulfuric acid-based copper sulfate solution is used as the electrolyte. At the beginning of the process a copper starting sheet or so-called permanent cathode, which can be made of acid-resistant steel or titanium, acts as a cathode plate. One or more rectifiers are used as the power source in the electrolysis. The current density used in electrolysis is typically 250–320 $A/m^2$ and the current is direct current (DC). Electrolysis takes place in separate electrolysis cells, where the number of anode-cathode pairs varies from plant to plant, but which is typically between 30 and 60 pairs. The number of electrolytic cells differs according to the plant. Anodes are typically dissolved in 14–21 days, the cathode cycle being 7–10 days.

The production capacity of an electrolysis plant is dependent upon the amperage applied in electrolysis, on the number of electrolytic cells and on the time and current efficiency. The efficiencies describe temporally how well the cells of the plant are used (by current) and how efficiently the electric current is used in precipitation of the copper. The capacity of the electrolysis plant is increased by raising the current density, building more electrolysis cells or by improving the efficiencies.

In patent application WO-0135083 a method is described for inspecting the surface quality of a ready cathode produced in an electrolysis, according to which method each cathode is inspected before removing the deposit from the permanent cathode. In the method the surface of the cathode is illuminated by at least one light source placed in an oblique position with respect to the cathode conveyor track, whereupon shadows are formed on the surface of the cathode by any irregularities in the surface. The checkpoint is equipped with a camera, which records an image of the illuminated surface of the cathode. The image obtained is then transmitted to an image processing device, where the image is processed by measuring the physical qualities of the shadows cast by the irregularities. On the basis of the physical qualities of the shadows, a quality classification of the cathode is carried out.

In electrolysis, it is difficult to collect real-time data of cathode quality during the cathode cycle. This causes one of the greatest problems in the process from the point of view of process- and production control. Data of quality is typically obtained only when the product, the cathode metal, has been produced, i.e. when it is no longer possible to affect the quality of the product in any way whatsoever. As mentioned above, the cathode cycle lasts for several days and, this being so, information of disturbances affecting the quality of the cathode can be obtained only by way of the final quality, i.e. all information is obtained after a long time delay.

Tests carried out in electrolysis have revealed that there is a clear correlation between cathode surface quality and crystal structure. A correlation also exists between crystal structure and chemical quality: the coarser the crystal structure, the more impurities remain in the cathode in the form of solution inclusions. Crystal structure is affected by the operating parameters of electrolysis: current density, electrolyte temperature and additives used in the process all have a great significance. Additives are the most difficult to analyze, and the ratios between additives in the electrolyte also affect crystal structure.

By means of the method according to the invention, it is the purpose to obtain information of the surface quality of cathodes already during the cathode cycle, and thus to eliminate the abovementioned shortcomings. In the method a cathode is lifted from the electrolysis cell during the cathode cycle, the surface of said cathode is photographed and the image obtained is analyzed and classified by image analysis software. By comparing the image with a previously created reference classification, the electrolysis process can be adjusted to produce a good quality cathode. The essential features of the invention are presented in the enclosed patent claims.

The invention relates to a method, by means of which it is possible to investigate the cathode surface quality in real time during the cathode cycle, and on the basis of this data to influence the electrolysis operating parameters. In this way, for example, the necessary changes can be made to the feed rate of additives even on the first day of growth and thus achieve better quality cathodes.

According to the method, cathode surface quality can be investigated with the aid of equipment based on image analysis, said arrangement comprising at least one camera, image processing software and equipment and equipment for locating the camera. The camera is preferably a digital or video camera, with which an image is taken, according to a previously devised plan, of the surface of a cathode lifted momentarily from the electrolytic cell. The camera can, of course, also be an analogical video or digital camera. On the basis of image analysis, real-time data on the growth of the cathode can be obtained.

With the aid of the method according to the invention, it is possible, for example to detect process and quality disturbances in the early stages, and corrective measures can be initiated much earlier than is currently possible. The method can be utilized in other operations relating to process control and, on the basis of the measurement data given by it, it is possible to make models predicting cathode quality from other process measurements.

Operations proceed in the method according to the invention as follows. The cathode, momentarily lifted from the electrolysis cell is photographed with the aid of a camera. The camera image is transmitted to image analysis software, which comprises for instance the AMT process (Angle Measure Technique) and also the multivariable analysis (Principal Component Analysis, Partial Least Squares) and possibly the self-organizing maps (SOM). Thus image-analysis and data classification techniques are used in processing the image information of the cathode surface. After photo-graphing, the cathode is set back into the electrolysis cell. The result obtained by the method is a class-type, i.e. by means of the above-mentioned software, the different types of cathodes are first classified by their growth into different reference classes. After this a predicting model is created for the cathode growth. After creating the model, the software compares the image obtained of the cathode to the prepared reference class images and the process is adjusted, either manually or automatically, to the correct operating point on the basis of instructions of that reference class.

What is claimed is:

1. A method for improving cathode quality, comprising photographing a surface of a cathode lifted from an electrolysis cell during a growth cycle to obtain an image, analyzing and classifying the image obtained with image-analysis software and, by comparing to a previously created reference classification, adjusting the electrolysis process in order to achieve a good-quality cathode.

2. A method according to claim 1, wherein image-analysis and data classification techniques are used in processing the cathode surface image information.

3. A method according to claim 1, wherein a separate reference classification is made for different types of cathode surface qualities.

4. A method according to claim 1, wherein there is a correlation between the cathode surface quality and its crystal structure.

5. A method according to claim 1, wherein a digital video camera is used in the photographing.

6. A method according to claim 1, wherein an analogical video camera is used in the photographing.

7. A method according to claim 1, wherein a digital camera is used in the photographing.

8. A method according to claim 1, wherein the electrolysis is a copper electrolysis.

* * * * *